US008291629B2

(12) United States Patent
Silverstein et al.

(10) Patent No.: US 8,291,629 B2
(45) Date of Patent: Oct. 23, 2012

(54) POINT OF PURCHASE GRAPHIC SIGN HOLDER DEVICE

(75) Inventors: Howard Silverstein, Great Neck, NY (US); Frank Calabrese, North Bellmore, NY (US)

(73) Assignee: Case Caddy Concepts, Inc., Great Neck, NY (US)

( * ) Notice: Subject to any disclaimer, the term of this patent is extended or adjusted under 35 U.S.C. 154(b) by 0 days.

(21) Appl. No.: 13/207,166

(22) Filed: Aug. 10, 2011

(65) Prior Publication Data

US 2012/0036752 A1 Feb. 16, 2012

Related U.S. Application Data

(60) Provisional application No. 61/372,146, filed on Aug. 10, 2010, provisional application No. 61/372,148, filed on Aug. 10, 2010.

(51) Int. Cl.
*G09F 3/00* (2006.01)

(52) U.S. Cl. ..... 40/606.01; 40/652

(58) Field of Classification Search ..... 40/606.01, 40/649, 650, 651, 658, 666; 24/655, 656, 24/561, 562, 564, 555, 556
See application file for complete search history.

(56) References Cited

U.S. PATENT DOCUMENTS

| | | | | |
|---|---|---|---|---|
| 179,476 | A * | 7/1876 | Hearttagen | 40/324 |
| 1,330,684 | A * | 2/1920 | Chwala | 40/652 |
| 4,044,485 | A * | 8/1977 | Hopp | 40/324 |

* cited by examiner

*Primary Examiner* — Casandra Davis
(74) *Attorney, Agent, or Firm* — Gottlieb, Rackman & Reisman, P.C.

(57) ABSTRACT

There is provided in a preferred embodiment of the present invention a sign holder having a plurality of tabs securing a sign within a cavity. Additionally, the sign holder includes a plurality of counter-facing projections for selectively attaching the sign holder to a panel.

6 Claims, 7 Drawing Sheets

POINT OF PURCHASE GRAPHIC SIGN HOLDER DEVICE

RELATED APPLICATIONS

This application claims priority to Provisional Application Ser. No. 61/372,146 and Ser. No. 61/372,148, both filed on Aug. 10, 2010 and incorporated herein by reference.

TECHNICAL FIELD

This invention relates generally to the field of display devices. More specifically, this invention involves a mountable body which includes counter-facing projections for securing the device to a panel, and tabs for securing a graphic to the device.

BACKGROUND OF THE INVENTION

Sign holders have been in existence for many years. Generally, sign holders include means for holding a sign and means for securing the holder to another object or surface. The sign holders are often taped or stapled to the object or surface. Many existing sign holders often require screws or other fasteners that necessitate labor to operate and include parts which may be lost or tampered with. One example of an existing sign holder is lithography printed paper which is mounted to a board and die cut to a shape. Such sign holders are expensive to produce and do not provide sufficient durability or rigidity. Further, existing sign holders are often knocked down or misaligned as a result of contact from customers.

Accordingly, there is a need for a sign holder which is durable, rigid capable of operating without additional materials or labor, and economical to produce.

SUMMARY OF THE INVENTION

There is provided a point of purchase graphic sign holder device comprising a body having a cavity for securing and displaying a point of purchase graphic and a plurality of counter-facing projections extending from the body and for selectively attaching the sign holder device to a panel.

In view of the limitations of the prior art, it is an object of the present invention to provide a sign holder device which is durable, rigid and economical.

A further objective of the present invention is to provide a sign holder device which does not require additional materials to be secured to a panel and which is durable and maintains its positioning in response to movement or jostling.

BRIEF DESCRIPTION OF THE DRAWINGS

The above-described and other advantages and features of the present disclosure will be appreciated and understood by those skilled in the art from the following detailed description and drawings of which.

DETAILED DESCRIPTION OF THE PRESENT INVENTION

With reference to FIGS. 1 through 8, there is shown a point of purchase graphic sign holder device comprising a sign holder 100 of the present invention. The sign holder 100 includes body 102 and projections 132, 134, 136. The body 102 is adapted to secure a graphic insert G. The projections 132, 134, 136 selectively attach to a panel P, most frequently an edge of a box of corrugated cardboard. The sign holder 100 is preferably constructed from a single piece of clear hard plastic.

Figure 1:
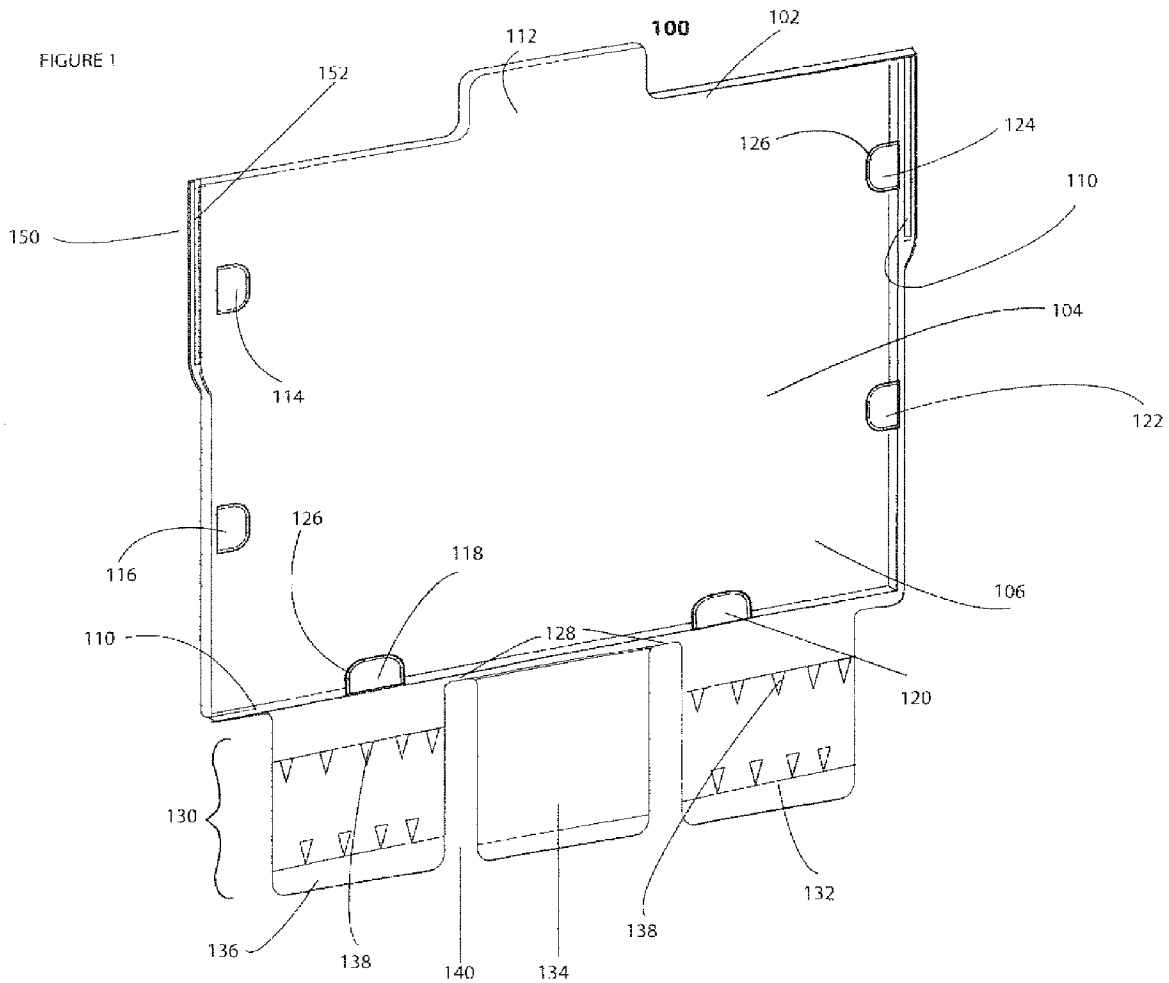
FIG. 1 is a front, top, right side perspective view of the graphic sign holder device of the present invention.
Figure 2:
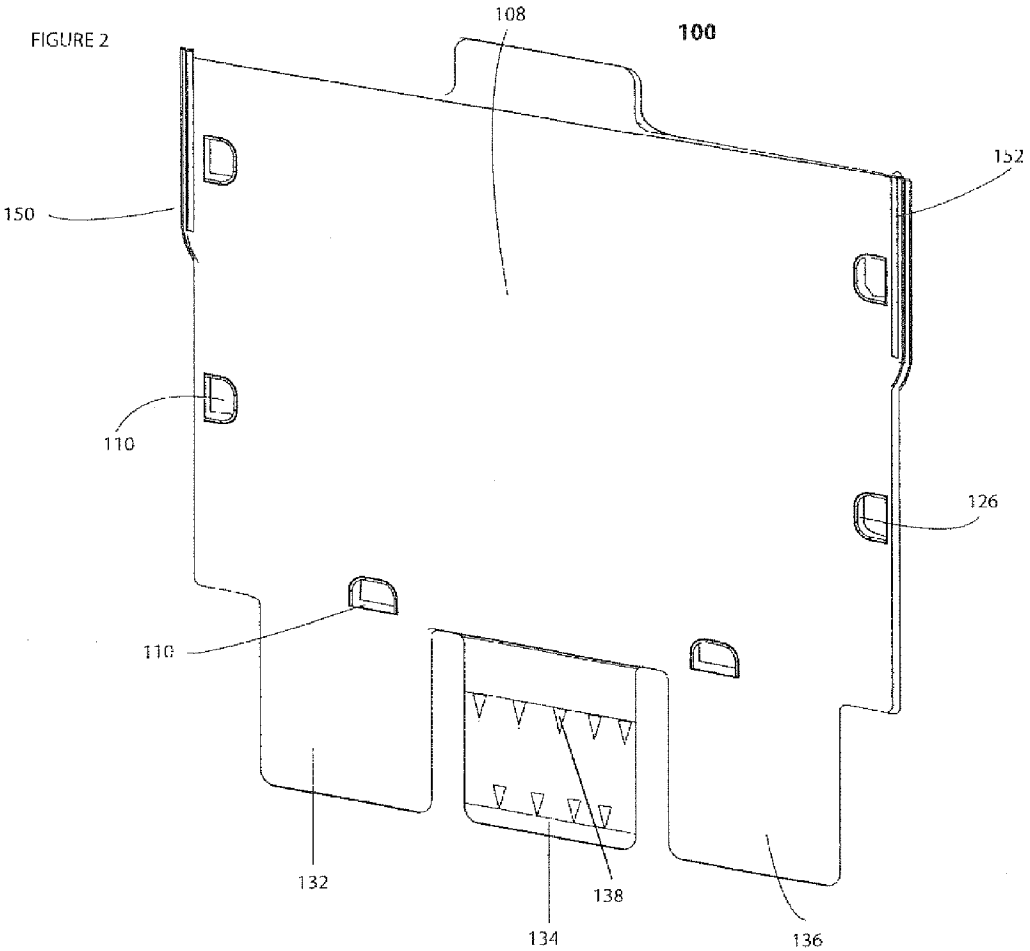
FIG. 2 is a back, top, right side perspective view thereof.

The body 102 further includes a front surface 104, a back surface 108, and a display tab 112. As illustrated in FIG. 1, the front surface 104 is set back into a thin cavity 106, exposing an inner surface 110. The inner surface 110 comprises an internal border of the cavity 106. The back surface 108 on the other hand is predominantly flush, as shown in FIG. 2.

Figure 9:
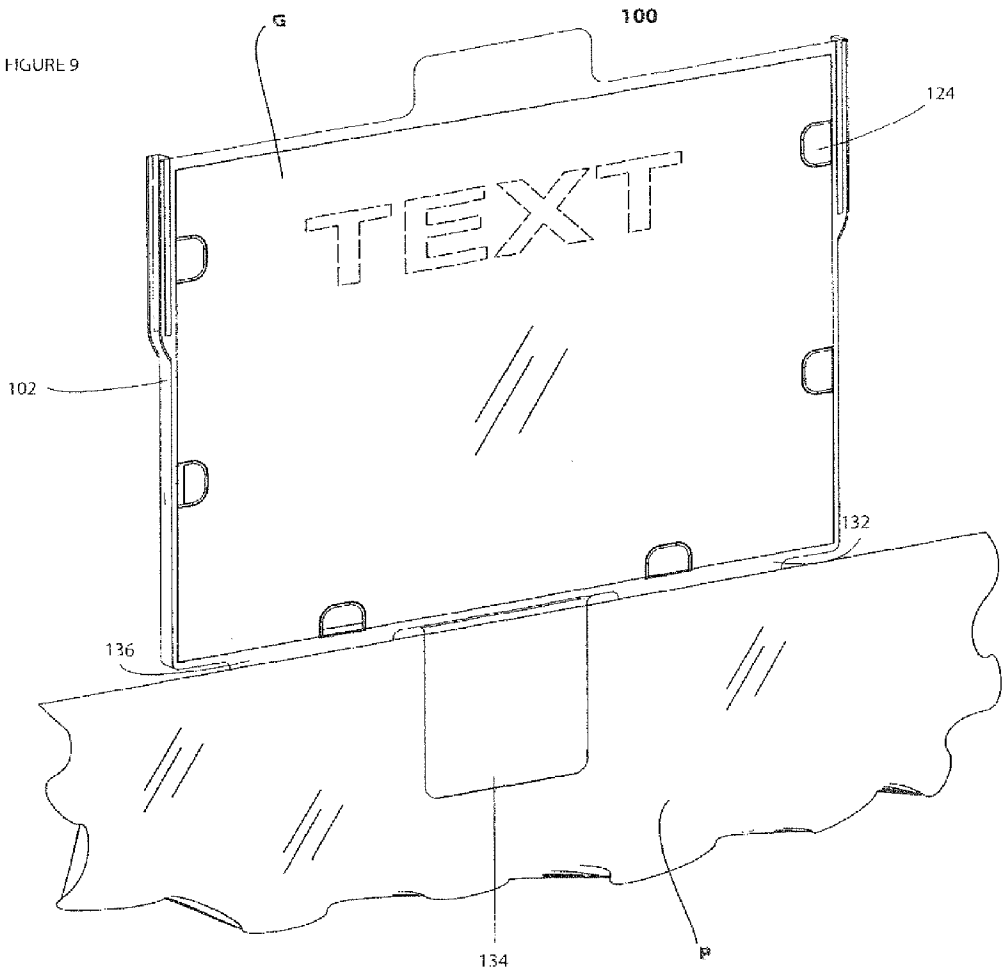
FIG. 9 is a perspective view of the graphic sign holder device of the present invention, fixed to a panel and including a graphic positioned in the cavity.

The cavity 106 is sized and adapted to receive a point of purchase graphic G, e.g., a paper or plastic advertisement. The graphic G is positioned with its back against the front surface 104 in cavity 106, as shown in FIG. 9. The graphic G is secured in place by a plurality of fastener tabs 114, 116, 118, 120, 122, 124. In the preferred embodiment of the sign holder 100, cavity 106 is rectangular and the tabs 114, 116, 118, 120, 122, 124 are positioned on three of the four sides of cavity 106—tab 114 in the upper right; tab 116 in the lower right; tab 118 in the bottom right, tab 120 in the bottom left, tab 122 in the lower left; and tab 124 in the upper left. The tabs are fixed to inner surface 110 and extend into the cavity 106 parallel to the front surface 104. Further, tabs 114, 116, 118, 120, 122, 124 are distant from the front surface 104 creating a plurality of tab slots 126 between the front surface 104 and the tabs 114, 116, 118, 120, 122, 124. Graphic G is positioned in tabs slots 126 when attached to sign holder 100. In the preferred embodiment, the section of body 102 aligned with tabs 114, 116, 118, 120, 122, 124 is removed and slots 126 are positioned between tabs 114, 116, 118, 120, 122, 124 and the plane of front surface 104.

Figure 3:
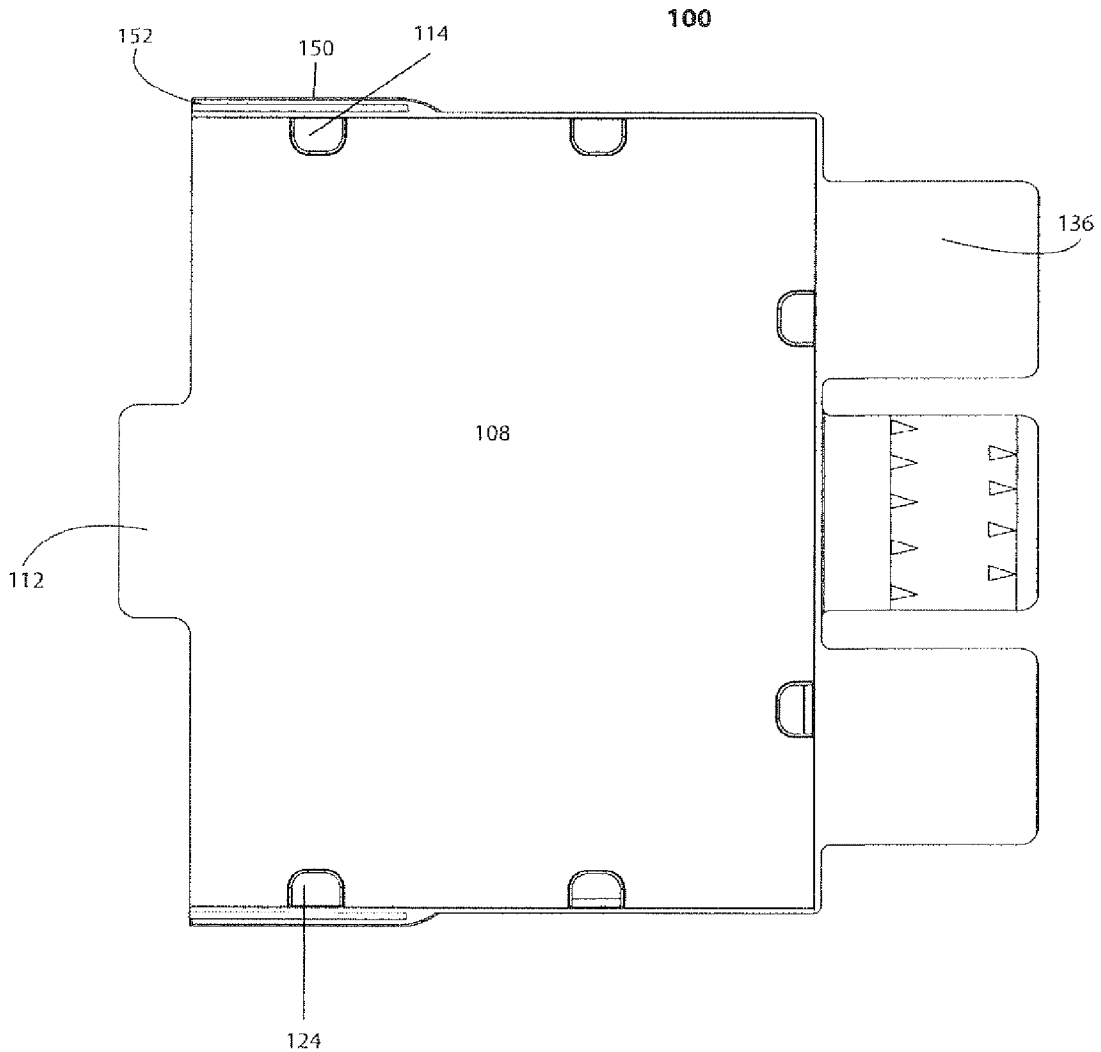
FIG. 3 is a back view thereof.
Figure 10:
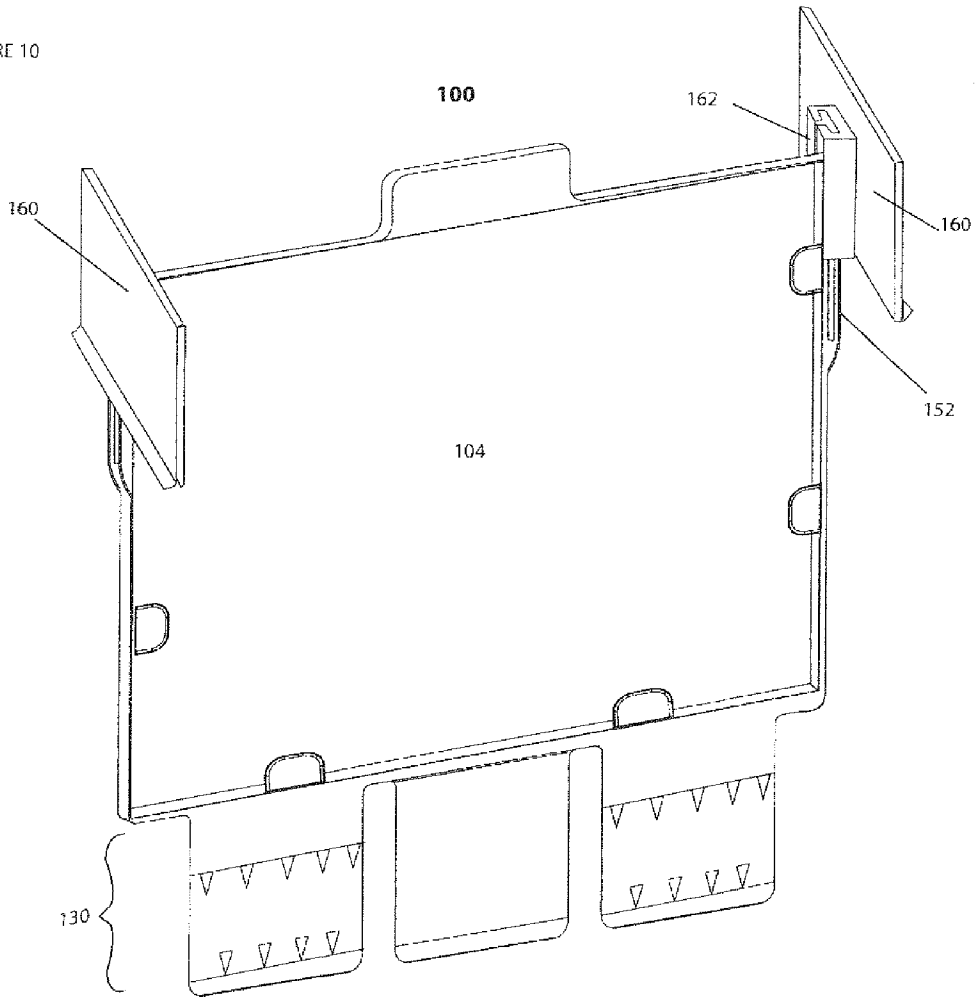
FIG. 10 is a perspective view of the graphic sign holder device of the present invention including two attached accessories.

In order to selectively attach to a panel or other object, sign holder 100 includes attachment assembly 130. Attachment assembly 130 extends away from the bottom 128 of body 102 and includes left counter-facing projection 132, center counter-facing projection 134 and right counter-facing projection 136. As shown in FIG. 1, left projection 132 and right projection 136 are positioned on the back side of lower wall 128 and each includes a plurality of tapered protrusions 138, facing the same direction as front surface 104. (Two embodiments of tapered protrusions 138 are illustrated in the attached drawings. A first embodiment including nine protrusions 138 per projection is shown in FIGS. 1, 2 and 10. A second embodiment including four protrusions 138 per projection is shown in FIG. 3.)

The center projection 134 is substantially identical in size and shape to left projection 132 and right projection 136. Center projection 130 is positioned on the front side of bottom 128 with the tapered protrusions 138 facing opposite the direction of front surface 104 and the tapered protrusions of left projection 132 and right projection 132.

Figure 4:
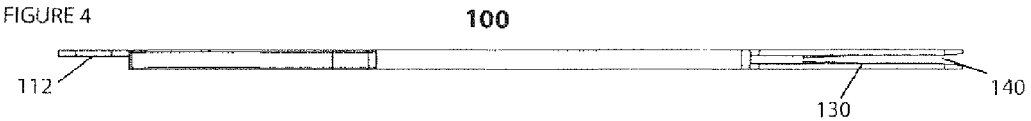
FIG. 4 is a side view thereof.
Figure 6:
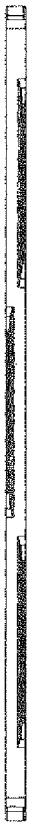
FIG. 6 is a bottom view thereof.
Figure 5:
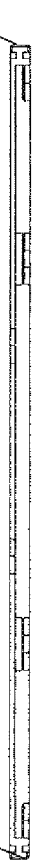
FIG. 5 is a top view thereof.
Figure 7:
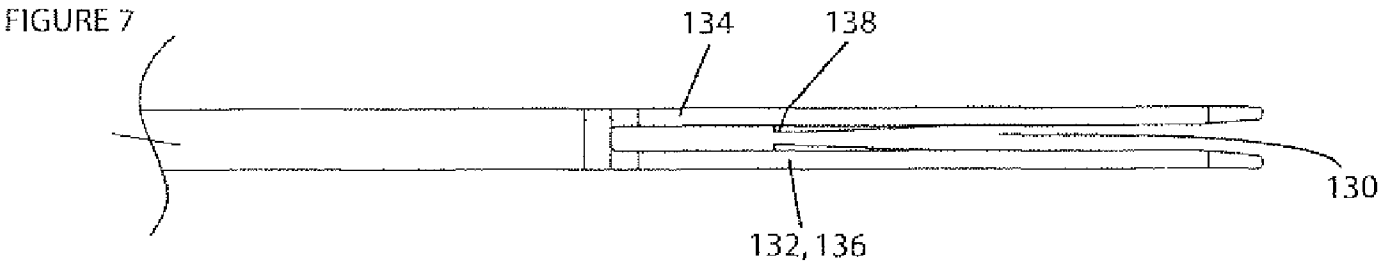
FIG. 7 is a side view of the counter-facing projections of the of the graphic sign holder device of the present invention.

Referring to FIGS. 4 and 7, a slot 140 is shown between the outside projections 132, 136 and the center projection 134. Also shown in FIG. 4 is the profile of the tapered protrusions 138, which shows the angled character of the protrusions 138. When the sign holder 100 is fixed to a panel, the panel is slid into the slot 140, whereby the tapered protrusions 138 apply force to the panel and create a compression fit between the attachment assembly 130 and a panel P, as shown in FIG. 9. The attachment of panel P to the sign holder 100 is secure, though panel P may be removed from the sign holder 100 without tools, using moderate strength.

In practice, attaching the sign holder 100 to a panel P involves securing the panel P with one hand and securing the top of sign holder 100 with one's second hand. Then the panel P is partially inserted in the slot 140. Once partially inserted, a downward force is applied to the top of sign holder 100 while panel P is held stationary completing the attachment. In order to remove panel P from sign holder 100, panel P and the top of sign holder 100 are again each gripped by one's hands. Then moderate opposing forces are applied to the panel P and the sign holder 100 until the two are separated. The separation is made easier by rocking the panel P back and forth relative to the sign holder 100, thereby loosening panel P from slot 140.

Figure 8:
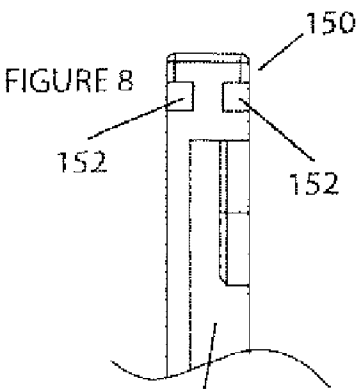
FIG. 8 is a top view of the accessory slot of the graphic sign holder device of the present invention.

As illustrated in FIGS. 8 and 10, sign holder 100 also includes an accessory slot 150 on the upper edge of body 102. Accessory slot 150 includes channel 152. The channel 152 is open at its upper most point and allows an accessory 160 having a matching fastener 162 to selectively attach to the sign holder 100. The attachment preferably involves fastener 162 being slid into channel 152. Accessory 160 preferably comprises a pad with a plurality of removable tickets. The tickets may provide a discount to complement the advertisement displayed in cavity 106.

While the sign holder 100 has been described with the graphic G facing away from body 102, the graphic G may be installed in cavity 106 facing either away from or towards the body 102. In the embodiment in which graphic G is installed, the sign holder 100 should be made a transparent or substantially transparent material, preferably clear plastic.

The accompanying drawings only illustrate one embodiment of a graphic sign holder device and its respective constituent parts, however, other types and styles are possible, and the drawings are not intended to be limited in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A device for securely holding a graphic, said device comprising:

a body having a cavity adapted to receive and to display a graphic;

a plurality of tabs adapted to secure said graphic in said cavity;

a plurality of counter-facing projections fixed to said body, said counter-facing projections being adapted to selectively attach said device to a panel;

an accessory slot, the accessory slot including a vertical channel having an opening at the channel's uppermost point; and an accessory selectively attached to the accessory slot, the accessory being a pad with a plurality of removable tickets.

2. The device for securely holding a display of claim 1, wherein said counter-facing projections include a plurality of angled protrusions.

3. The device for securely holding a display of claim 1, wherein said body includes three sides, each side having an inner surface, said tabs being fixed to said inner surfaces.

4. The device for securely holding a display of claim 1, wherein said plurality of counter-facing projections includes a central projection facing a first direction and two side projections facing a direction option said first direction.

5. The device for securely holding a display of claim 4, wherein the central projection is substantially identical in size and shape to the side projections.

6. The device for securely holding a display of claim 1, wherein the device is made of a transparent material.

* * * * *